United States Patent [19]

Rushford

[11] Patent Number: 4,640,046

[45] Date of Patent: Feb. 3, 1987

[54] REVOLVING DOOR COLLAPSING MECHANISM

[75] Inventor: Calvin R. Rushford, Reed City, Mich.

[73] Assignee: Indal, Inc., Reed City, Mich.

[21] Appl. No.: 746,236

[22] Filed: Jun. 18, 1985

[51] Int. Cl.[4] ..... E05D 15/02

[52] U.S. Cl. ..... 49/44; 49/42; 49/141

[58] Field of Search ..... 49/42, 44, 141

[56] References Cited

U.S. PATENT DOCUMENTS

| | | | |
|---|---|---|---|
| 1,886,502 | 11/1932 | Shields | 49/44 |
| 1,914,237 | 6/1933 | Blanchard | 49/44 |
| 2,539,750 | 1/1951 | Nordin | 49/44 |
| 3,495,251 | 2/1970 | Lowe | 49/44 |
| 3,736,701 | 6/1973 | Rush et al. | 49/44 |
| 3,762,098 | 10/1973 | Sheckells | 49/44 |
| 3,766,686 | 10/1973 | Sheckells | 49/44 |
| 3,782,035 | 1/1974 | Lowe | 49/44 |
| 3,793,773 | 2/1974 | Sheckells | 49/44 |
| 3,886,684 | 6/1975 | Sheckells | 49/44 |
| 4,332,108 | 6/1982 | Appelmann | 49/44 |

*Primary Examiner*—Francis K. Zugel
*Assistant Examiner*—Gerald A. Anderson
*Attorney, Agent, or Firm*—Varnum, Riddering, Schmidt & Howlett

[57] ABSTRACT

A collapsible revolving door in which a plurality of leaves (32, 34, 36) are mounted to an upper cam housing (52) and a lower cam housing (56) for rotation about a central axis. Each of the leaves is mounted to a cam (80) through a pivot shaft (60) for rotation about a central axis of the cam (80) and the pivot axis (60). Each cam (80) has substantially opposed engaging sockets (84, 86) and substantially opposed collapsing sockets (88, 90). Dentent mechanisms (92) have semispherical cam followers (96) which are positioned in the engaging sockets (84, 86) when the leaves are radially oriented about the central axis. Under panic conditions, the door leaves (32, 34, 36) rotate about the pivot shafts (60) against the retaining force of the detent mechanism (92), whereby the detent mechanisms will register with the collapsing sockets (88, 90). Adjustment blocks (98) are adjustable mounted in the housing (52, 54) to simultaneously adjust the bias on two adjacent detent mechanism springs (94).

15 Claims, 5 Drawing Figures

REVOLVING DOOR COLLAPSING MECHANISM

FIELD OF THE INVENTION

This invention relates to revolving doors. In one of its aspects, it relates to a collapsing mechanism for allowing a door to collapse under panic conditions.

STATE OF THE PRIOR ART

Revolving doors typically comprise three or four transparent glass leaves which are angularly spaced about a vertical axis and which rotate together about the axis when the door is in normal use. The leaves are mounted to collapsing mechanisms which are designed to allow the leaves to collapse flat against one another in the event that they are subjected to abnormal forces such as would occur if a large number of people attempted to pass through the door as in a panic situation. The collapsing mechanisms thus provide a safety feature to allow people to pass straight through the door in the event of fire or other emergency. The leaves can also be deliberately collapsed to allow unusually large items to be transported through the door.

Examples of collapsing door mechanisms are found in the following U.S. patents:

| | |
|---|---|
| Appelmann (issued June 1, 1982) | 4,332,108 |
| Rush et al (issued June 5, 1973) | 3,736,701 |
| Lowe (issued February 10, 1970) | 3,495,251 |
| Shekells (issued October 2, 1973) | 3,762,098 |
| Lowe (issued January 1, 1974) | 3,782,035 |
| Blanchard (issued June 13, 1933) | 1,914,237 |
| Sheckells (issued October 23, 1973) | 3,766,686 |
| Sheckells (issued June 3, 1975) | 3,886,684 |
| Sheckells (issued February 26, 1974) | 3,793,773 |

In the Appelmann patent, a collapsing three-wing revolving door has latching mechanisms which mount the wings to bearing plates. Each of the latching mechanisms comprises a pin which is nonrotatably mounted in the inner ends of the door, is rotatably mounted in a latching housing and is nonrotatably mounted in an elongated latch member within the housing. Spring-biased detents are provided in the ends of the latch member and the detents engage indentations in the outer portion of the housing at one end and at the central portion of the housing at the other end when the door is radially aligned. Significant force on the door with respect to the latching mechanisms rotates the latch members with respect to the housing to collapse the doors.

The Lowe '701 patent discloses a collapsing revolving door mechanism similar to Appelmann except that the pins are mounted to a latching mechanism at an inner end thereof and extend through slots in the latch mechanism housing. Upon rotation of the Lowe '701 doors with respect to the housing, the pins slide in the housing slots to allow the doors to collapse to a position parallel to each other. A detent mechanism is provided at the outer end of each latch member to engage an outer ring in the housing and a central hub provides a bearing surface against which the latch element is forced by the spring-loaded detent member at the outer portion of the latch member.

The patent to Rush et al discloses a collapsible revolving door very similar to the Lowe '251 structure. However, the collapsing mechanisms in Rush et al are independent of each other and are supported by bearing plates at the top and bottom of the door opening.

The patent to Lowe '035 discloses a collapsing revolving door mechanism wherein vertically positioned spring-loaded detents are provided between a bearing plate and the revolving doors to releaseably maintain the doors in radially aligned positions. The doors are pivotably mounted about an axis offset from the plane of the door to allow the doors to collapse in a parallel relationship.

The patent to Blanchard discloses a collapsible revolving door mechanism in which the doors are mounted to a central plate through a pair of shafts which slide within slots in the plate and a spring-loaded detent mechanism in the end of the door releaseably retains the door in a radial position. It appears that the spring-loaded detent mechanism is adjustable to adjust the force applied by the spring-loaded detent mechanism.

The patents to Sheckells '098 and '773 discloses a collapsing door mechanism similar to Blanchard. The Schekells '684 patent discloses a collapsing door mechanism wherein the wings are connected to independent rings which are concentric with the central support shaft for the doors. The rings have detent assemblies which releaseably secure the doors in radial position on the central shaft. The force applied by the detent mechanism appears to be adjustable through an adjustable plug in a bore which retains one end of the spring of the detent mechanisms.

It may be important to adjust the force at which the doors collapse for different conditions and for spring fatigue. No three-way door collapsing mechanism provides this function. The Sheckells '686, '684 and '773 all appear to provide this function for four-wing doors. However, each door is independently adjustable and there is no mechanism for coordinating the collapsing force for each door.

SUMMARY OF THE INVENTION

According to the invention, a collapsible revolving door comprises a plurality of door leaves which are mounted to upper and lower housings for rotation about a central axis under normal conditions but for rotation about radially offset vertical axes when the door leaves are subjected to panic conditions. According to the invention, a cam means is mounted for rotation about the offset axis within at least one of the upper and lower housings and is nonrotatably connected to one of the door leaves. The cam has a substantially vertical peripheral surface and at least one retaining indentation, preferably two sets of opposed indentations in the peripheral surface. Detent means are mounted in the housing for engaging the indentations to releaseably maintain the cam rotationally fixed in the one housing when the one leaf is radially oriented with respect to the central axis. Preferably, a plurality of cam means, each of which is mounted for rotation about an offset vertical axis, are provided within the one housing and each of the cams is nonrotatably mounted to a separate door leaf. Resilient detent means are mounted in the housing for registry with the retaining indentations in the cams to releaseably maintain the cams rotationally fixed in the one housing when the leaves are radially oriented with respect to the central axis. Means are provided for adjusting the bias of two of the resilient detent means simultaneously so that the collapsing force on adjacent leaves can be simultaneously adjusted.

In a preferred embodiment of the invention, the resilient detent means comprises a spring and a follower element which is engageable with the cam indentations. Preferably, the housing has horizontal bores in which the detent means are positioned.

The adjusting means preferably comprises a block slidable radially in the one housing and a threaded fastener threadably engaging the housing for adjusting the radial position of the block in the housing. Each of the blocks has a pair of bearing surfaces, each of which is adapted to bear against a detent means.

In a preferred embodiment of the invention, each of the door leaves is mounted to the one housing through an identical cam means and a pair of detent means are provided for each cam means, each detent means engaging an opposed retaining indentation on the peripheral surface of a cam. Further, the invention contemplates a plurality of radially slidable blocks, one for each adjacent pair of detent means.

Further, each of the upper and lower housings has identical mounting means for the leaves, which mounting means include the same cams, resilient detent means and tension- adjusting means. Still further according to the invention, each of the cams has elongated slots in the vertical peripheral surface angularly spaced thereabout from the retaining indentations and adapted to register with the opposed detent means when the door leaves are in the collapsed position.

BRIEF DESCRIPTION OF DRAWINGS

The invention will now be described with reference to the accompanying drawings in which.

DETAILED DESCRIPTION OF THE DRAWINGS

Figure 1:
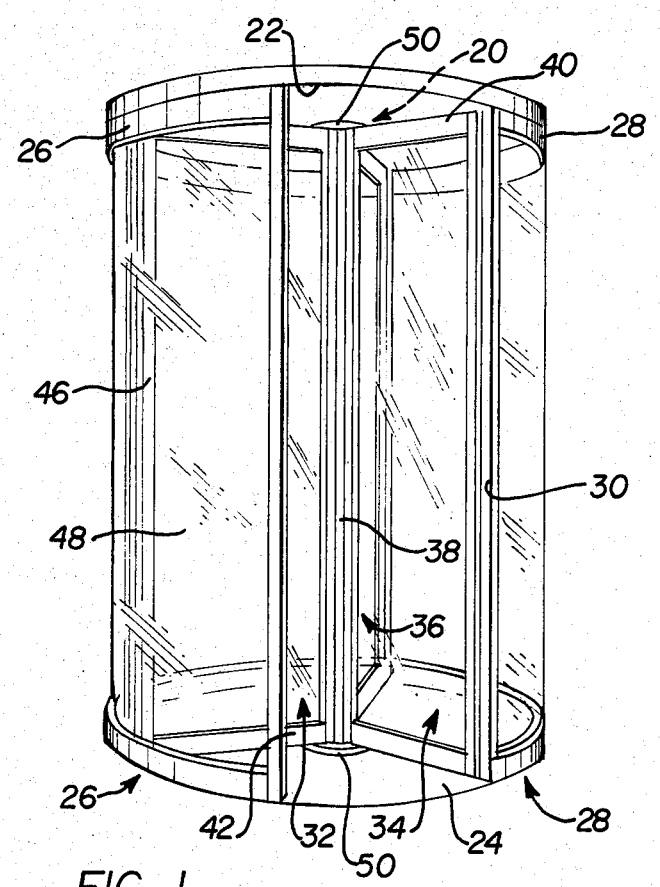
FIG. 1 is a perspective view of a revolving door according to the invention.

Referring to FIG. 1, there is shown a revolving door 20 installed in a doorway defined by a ceiling 22, floor surface 24 and curved transparent walls 26 and 28. An access opening 30 is shown between the walls 26 and 28, at one side of the door and a similar opening (not visible) is defined by the curved transparent walls 26 and 28 at the opposite side of the door. In this particular embodiment, the door 20 has three door leaves 32, 34 and 36 which normally extend radially outwardly from a generally vertical central shaft 38 in equi-angularly spaced positions.

The door leaves 32, 34 and 36 are identical with one another and for the sake of brevity, only one will be described. Referring to door leave 32, by way of example, each door has a upper rail 40 and a lower rail 42, an inner vertical stile 44 and an outer vertical stile 46. The upper and lower rails 40 and 42 respectively, and the inner and outer vertical stile 44 and 46 respectively form a frame supporting a sheet of toughened glass 48. The center shaft 38 is mounted to a collapsing mechanisms 50 at the upper and lower extremities thereof.

Figure 2:
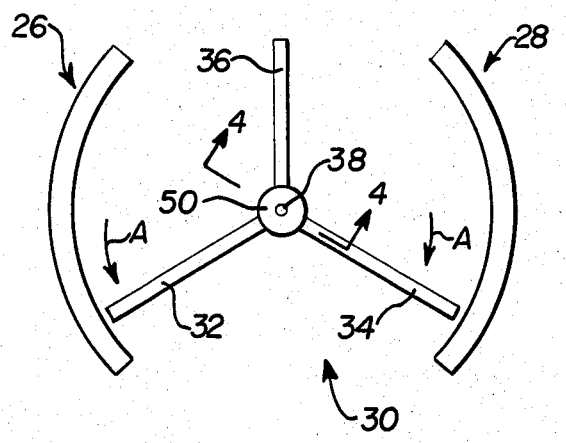
FIG. 2 is a schematic top view of the revolving door shown in FIG. 1 showing the leaves of the door in their normal radial position.

As seen in FIG. 2, the door leaves 32, 34 and 36 respectively are shown in their normal radial positions. This position depicts the collapsing mechanisms 50 in an engaged position.

Figure 3:
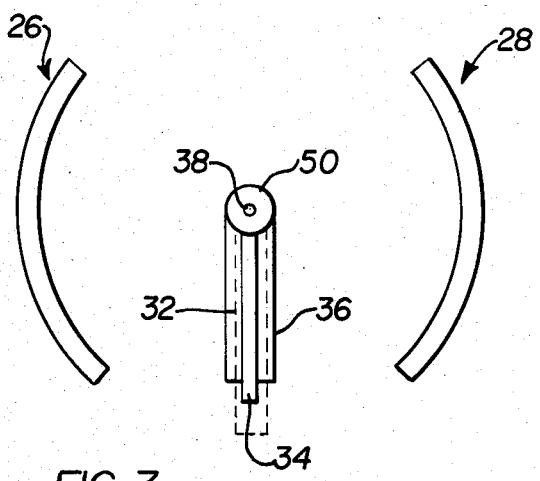
FIG. 3 is a schematic top view like FIG. 2 but showing the leaves of the door in their collapsed positions.

As seen in FIG. 3, the door leaves 32, 34 and 36 are shown collapsed flat against one another. Collapsing occurs when abnormally high forces are applied to the outermost door leaves 32 and 36 in the direction indicated by the arrows A in FIG. 2. In this particular example, door leaf 34 has not moved from its normal radial position because of the directions in which the abnormal forces were applied. However, door leave 34 has the faculty to collapse if necessary in the same manner as leaves 32 and 36.

Figure 4:
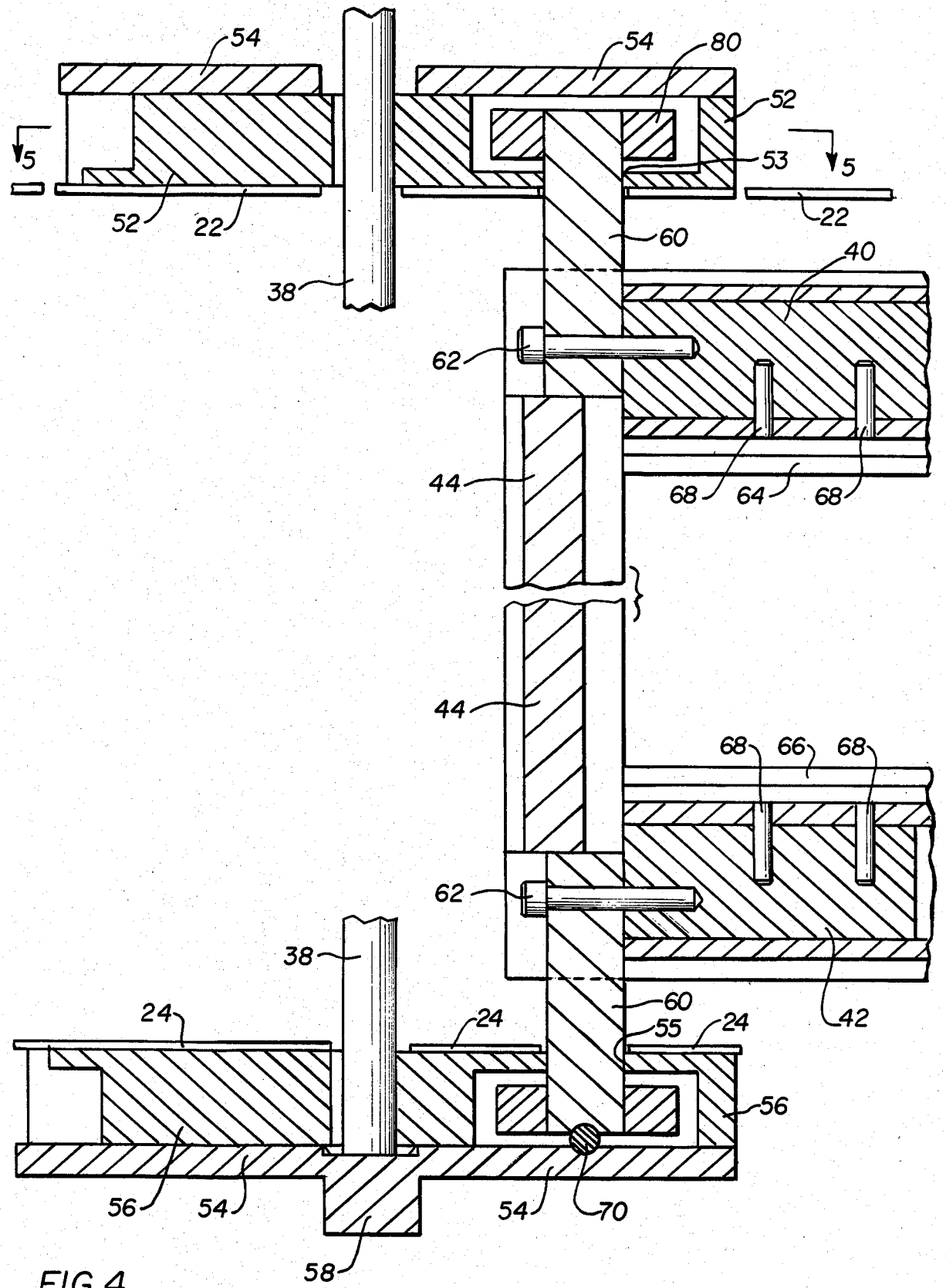
FIG. 4 is a segmented sectional view taken along line 4—4 of FIG. 2.

Referring now to FIG. 4, the center shaft 38 has an upper cam housings 52 mounted non-rotatably thereto. A housing cover 54 is mounted to the open top of a housing 52 and about center shaft 38. A cam housing 56 is likewise mounted non-rotatably to shaft 38 at the bottom thereof. A bottom cam housing cover 54 having a pivot pin 58 is mounted beneath the lower cam housing 56. Pivot shafts 60 are pinned to the upper and lower rails 40 and 42 through a socket head bolt 62 and are journalled in the respective housings 52 and 56 through holes 53 and 55, respectively.

Upper and lower door arms 64 and 66 respectively securely embrace the toughened glass 48 and are mounted to the upper and lower rails 40 and 42 with convential pins 68.

The bottom pivot 58 enables the center shaft 38 to rotate about the central axis of the center shaft 38 while securely supporting the revolving door 20. A ball bearing 70 is positioned beneath each lower the pivot shaft 60 to support the respective door and allow it to rotate about the pivot shaft 60 during collapse of the door.

Figure 5:
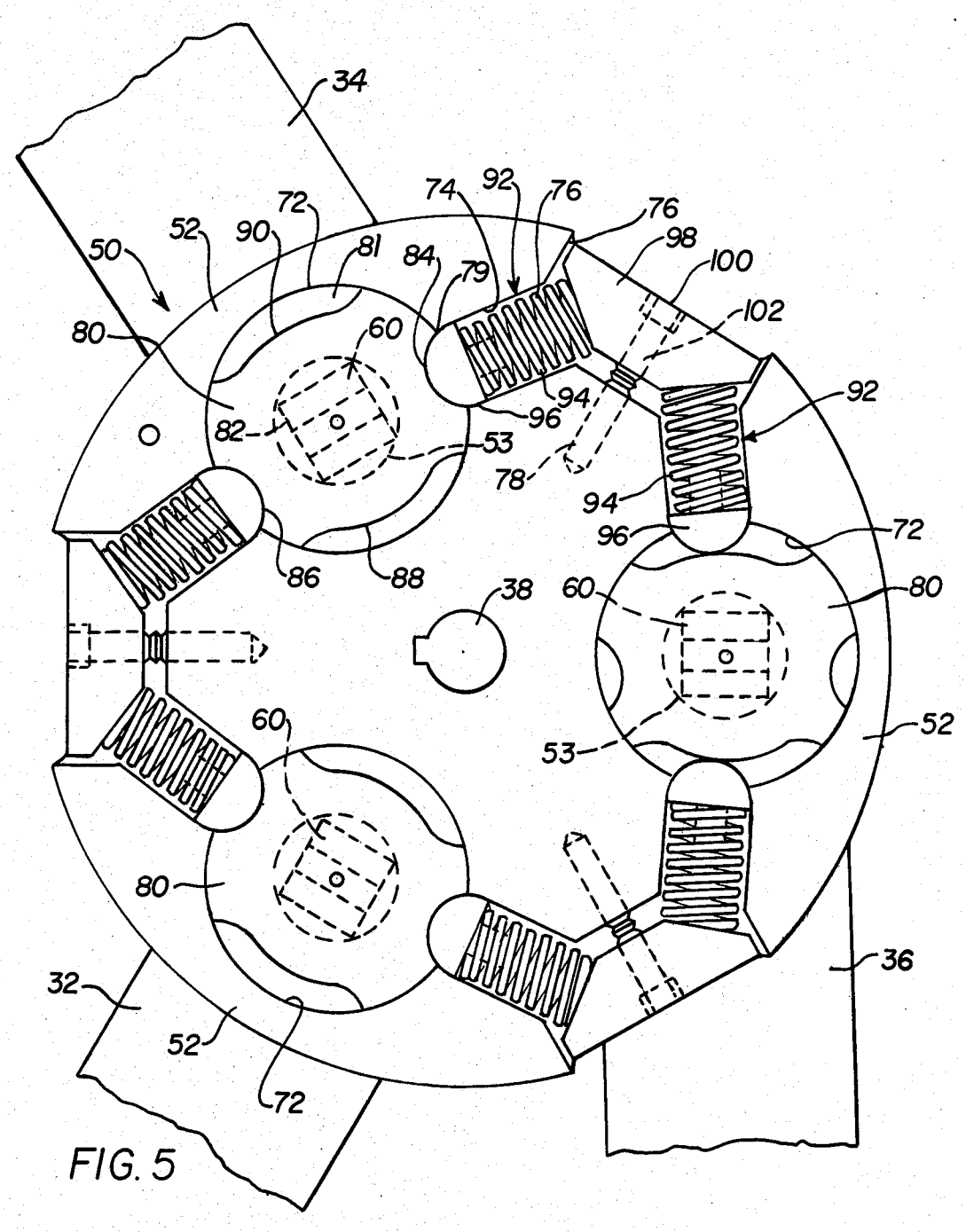
FIG. 5 is a view depicting the interior of the cam housing taken along line 5—5 in FIG. 4.

As seen in FIG. 5, the upper collapsing mechanism 50 includes the upper cam housing 52 which has three vertical circular cavities 72 which are equally spaced from each other about the center shaft 38. Lateral bores 74 are provided between each circular cavity 72 and rectangular socket 76. Tapped holes 78 are provided radially inwardly from the end of each of the rectangular sockets 76. A cam 80 is mounted in each of the circular cavities 72. Each cam 80 has a square central opening 82 in which each respective pivot shaft is secured for nonrotational movement therewith. A pair of substantially opposed engaging sockets 84 and 86 are provided in the vertical peripheral surface of each of the cams 80 and relatively wide collapsing sockets 88 and 90 are provided in opposed relationship in the vertical peripheral surface of the cam 80 and between the engaging sockets 84 and 86.

Detent mechanisms 92 are provided within each of the lateral bores 74 and include a spring 94 and a semi-spherical cam follower 96. Adjustment blocks 98 are positioned in the rectangular sockets 76 and have beveled surfaces which bear against two of the coil springs 94 to bias the cam followers 96 against the respective cams 80. A hex-head bolt 100 extends through a bore 102 in each adjustment block 98 and threads into the tapped hole 78 to adjustably mount the adjustment block 98 in the rectangular sockets 76. By adjusting the screw 100, the tension in springs 94 and thus the pressure of the semi-spherical cam followers 96 against the cams 80 can be adjusted.

In operation, the doors will normally be positioned in the equi-angularly spaced position illustrated in FIG. 2. In this condition, the cam followers 96 will be positioned within the engaging sockets 84 of the cams 80 as illustrated for the doors 32 and 34 in FIG. 5. Normal pressure on the doors, for example in a counter-clockwise direction as viewed in FIG. 5, will cause the door leaves 32, 34 and 36 to rotate about a central axis. Rotational force on the door leaves will be transmitted through the pivot shafts 60 to the cams 80 and through the cams 80 to the upper cam housing 52 and the lower cam housing 56. The cams 80 are maintained in their rotational position under ordinary conditions by the force of the semi-spherical cam followers 96 in the sockets 84. Thus, the cam housings 52 and 54 will rotate the center shaft 38 and the entire door assembly will rotate about a central axis of the center door shaft 38.

When extraordinary forces are applied to two doors in opposite directions, such as by the force lines A illustrated in FIG. 2, the force of the cams on the upper and lower housings 52 and 54 will be equal and opposite. Thus, the force on the doors will cause the cams themselves to rotate about the axes of pivot shafts 60 with respect to the upper and lower cam housings 52 and 54. The force on the door leaves will disengage the cam followers 96 from the respective engaging sockets 84 and 86 as the force on the doors overcomes the pressure of the coil springs 94 against the cams 80. The door leaves will rotate until the cams reach the position illustrated in FIG. 3. In this position, the cams 80 will rotate approximately 120, the cam followers 96 resting in the collapsing sockets 88 and 90. The position of one such cam 80 is shown in the right side of the upper cam housing 52 in FIG. 5.

If it is desirable to adjust the force at which the doors will collapse, the hex-head bolts 100 are either tightened or loosened to move the adjustment blocks 98 radially inwardly or outwardly with respect to the cam housings 52 and 54. This adjustment can be easily made without removing any of the collapsing mechanism from its housing.

The invention provides a simple and effective manner in which the leaves of the door can be mounted for rotation about a central axis under normal conditions and wherein the doors will collapse under panic conditions in an appropriate manner. Further, the invention provides a mechanism for easily adjusting the forces which are required to maintain the doors in their radially spaced positions.

Reasonable variation and modification are possible within the scope of the foregoing disclosure and drawings without departing from the spirit of the invention.

The embodiments of the invention in which an exclusive property or privilege is claimed are defined as follows:

1. In a collapsible revolving door comprising:

a central shaft;

upper and lower housing means mounted respectively to upper and lower portions of the central shaft and adapted to be mounted to the ceiling and floor respectively of a building opening;

a plurality of door leaves;

means for mounting each of the door leaves to the upper and lower housing means for rotation therewith about a central vertical axis of the central shaft under normal conditions, but for rotation about a second vertical axis radially offset from the central axis when the door leaves are subject to panic conditions;

the improvement in the door leaves mounting means comprising:

a cam means mounted for rotation about said second axis within at least one of said upper and lower housing means and nonrotatably connected to each of said door leaves;

said cam means having a substantially vertical peripheral surface and at least one retaining indentation in the peripheral surface;

at least one horizontal bore for each of said cam means in said one housing means in registry with the peripheral surface of said cam means;

at least one resilient detent means mounted in each of said horizontal bores for engaging said at least one indentation to releasably maintain said cam rotationally fixed in said one housing when said one leaf is radially oriented with respect to said central axis; and a block movably mounted in said one housing means in abutting relationship with each of said detent means; and threaded means for adjustably securing said blocks in said one housing to adjust the tension in said resilient detent means.

2. A collapsible revolving door according to claim 1 wherein each of said detent means comprises a spring and a follower element, said follower element being engageable with said cam means indentation.

3. A collapsible revolving door according to claim 2 wherein each of the door leaves is mounted to the one housing means through an identical cam means and a pair of detent means are provided for each cam means.

4. A collapsible revolving door according to claim 2 wherein the other of the upper and lower housing means has a mounting means for the door leaves, which mounting means includes the cam means and the resilient detent means.

5. A collapsible revolving door according to claim 1 wherein each of the door leaves is mounted to the one housing means through an identical cam means and a pair of detent means are provided for each cam means.

6. A collapsible revolving door according to claim 1 wherein the other of the upper and lower housing means has a mounting means for the door leaves, which mounting means includes the cam means and the resilient detent means.

7. A collapsible revolving door according to claim 1 and further comprising elongated slots in the vertical peripheral surface of said cam means angularly spaced from the retaining indentations and adapted to register with the opposed detent means when the one door leaf is in a collapsed position.

8. In a collapsible revolving door comprising:

a central shaft;

upper and lower housing means mounted respectively to upper and lower portions of the central shaft and adapted to be mounted to the ceiling and floor respectively of a building opening;

a plurality of door leaves;

means for mounting each of the door leaves to the upper and lower housing means for rotation therewith about a central vertical axis of the central shaft under normal conditions, but for rotation about a second vertical axis radially offset from the central axis when the door leaves are subject to panic conditions;

the improvement in the door leaves mounting means comprising:

a cam means mounted for rotation about said second axis within at least one of said upper and lower housing means and nonrotatably connected to one of said door leaves;

said cam means having a substantially vertical peripheral surface and two substantially opposed retaining indentations in the peripheral surface;

a pair of resilient detent means each comprising a spring and a follower element mounted in said one housing means in substantially opposed relationship for said follower elements to engage said opposed indentations to releasably maintain said cam rotationally fixed in said one housing when said one leaf is radially oriented with respect to said central axis;

said one housing means has horizontal bores and said detent means are positioned within said horizontal bores;

a block slidable radially in said one housing means and a threaded fastener threaded into the one housing means for adjusting the radial position of the block to thereby adjust the tension in said detent means.

9. A collapsible revolving door according to claim 8 wherein each of the blocks is adapted to simultaneously adjust the tension in two adjacent detent means.

10. A collapsible revolving door according to claim 9 wherein each of the door leaves is mounted to said one housing means through an identical cam means and a pair of detent means are provided for each cam means.

11. A collapsible revolving door according to claim 10 wherein there are a plurality of said radially slidable blocks, one for each pair of adjacent detent means.

12. A collapsible revolving door according to claim 11 wherein the other of the upper and lower housing means has a mounting means for the door leaves, which mounting means includes said cam means, said resilient detent means and said tension- adjusting means.

13. A collapsible revolving door according to claim 10 wherein the other of the upper and lower housing means has a mounting means for said door leaves, which mounting means includes the cam means, the resilient detent means and the tension-adjusting means.

14. In a collapsible revolving door comprising:

a central shaft;

upper and lower housing means mounted respectively to upper and lower portions of the central shaft and adapted to be mounted to the ceiling and floor respectively of a building opening;

a plurality of door leaves;

means for mounting each of the door leaves to the upper and lower housing means for rotation therewith about a central vertical axis of said central shaft under normal conditions, but for rotation about other vertical axes radially offset from the central axis when the door leaves are subjected to panic conditions;

the improvement in the door leaves mounting means comprising:

a plurality of cam means, each of which is mounted for rotation about one of the other vertical axes radially offset from the central axis within at least one of the upper and lower housing means, and each of which cam means is nonrotatably mounted to a separate door leaf;

each of said cam means having a substantially vertical peripheral surface and at least one retaining indentation in the peripheral surface;

a resilient detent means mounted in said one housing means for registry with said one retaining indentation to releaseably maintain said cam means rotationally fixed in said one housing means when said leaves are radially oriented with respect to said central axis; and means in said one housing means for simultaneously adjusting the force of two of said resilient detent means against said cam means.

15. A collapsible revolving door according to claim 14 wherein said adjusting means comprises a block slidable radially in said one housing means and a threaded fastener threaded into the one housing means for adjusting the radial position of the block within the one housing means and said blocks being adapted to simultaneously adjust the force of two adjacent detent means against said cam means.

* * * * *